United States Patent [19]

Minami

[11] Patent Number: 4,502,246

[45] Date of Patent: Mar. 5, 1985

[54] DEVICE FOR CATCHING A FULLY OPENED SLIDE DOOR

[75] Inventor: Tatsuo Minami, Isehara, Japan

[73] Assignee: Nissan Shatai Co., Ltd., Kanagawa, Japan

[21] Appl. No.: 475,248

[22] Filed: Mar. 14, 1983

[30] Foreign Application Priority Data

Jun. 29, 1982 [JP] Japan ..... 57-96764[U]

[51] Int. Cl.[3] ..... E05D 17/00

[52] U.S. Cl. ..... 49/322; 49/213; 49/218; 49/223; 49/449

[58] Field of Search ..... 49/209, 213–225, 49/449, 322

[56] References Cited

U.S. PATENT DOCUMENTS 3,100,667 8/1963 Schwenk ..... 49/214

4,110,934 9/1978 Zens ..... 49/223 X

FOREIGN PATENT DOCUMENTS 2082660 3/1982 United Kingdom ..... 49/213

*Primary Examiner*—Kenneth Downey

*Attorney, Agent, or Firm*—Daniel M. Rosen

[57] ABSTRACT

For the purpose of holding a slide door of a vehicle at its fully opened position, a catch lever is provided on a bracket which is pivotally mounted on the slide door and a stopper means is additionally provided on the bracket to prevent the excessive pivoting of the catch lever. Because of the pivotable mounting of the bracket and the provision of the stopper means, the catch lever is prevented from being interfered by a curved portion of the guide rail guiding the sliding motion of the slide door for smooth opening and closing of the door and the device is free from any pronounced protrusion on the part of both the door and the guide rail.

11 Claims, 9 Drawing Figures

DEVICE FOR CATCHING A FULLY OPENED SLIDE DOOR

TECHNICAL FIELD

This invention relates to a device for catching a fully opened sliding door of a vehicle and in particular to such a device which does not impair the smooth closing and opening of the sliding door and does not present any unattractive protrusion from the guide rail supporting and guiding the sliding door.

BRIEF DESCRIPTION OF THE DRAWINGS

The invention and prior art are described with respect to the appended drawings, in which.

BACKGROUND ART

Conventionally, a sliding door of a vehicle for passengers and cargos was supported on a vehicle body so as to be slidable along guide rails at its top, bottom and waist portions. And such a sliding door is prevented from being freely moveable not only at its fully closed position but also at its fully opened position for both safety and convenience.

Since a sliding door is naturally mounted on a side of a vehicle body in a slidable manner, a catch means is provided on either a ceiling portion, a floor portion or a waist portion of the vehicle door for the purpose of holding the door in particular at its fully opened position.

Figure 1:
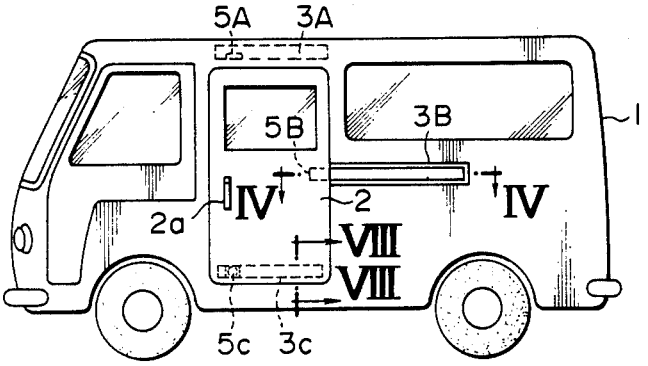
FIG. 1 is a schematic side view of a typical vehicle having a sliding door.

FIG. 1 is a side view of a typical vehicle having a sliding door 2, showing an external appearance of the vehicle. This sliding door 2 is slidably supported on a vehicle body 1 by rollers 5A, 5B and 5C which can roll over the surfaces of guide rails 3A, 3B and 3C fixedly secured to a ceiling, a floor and a waist portions of the vehicle body 1. And the sliding door 2 is held at its fully opened position by a catch device provided on one of the guide rails fixedly secured to the vehicle body 1.

Figure 2:
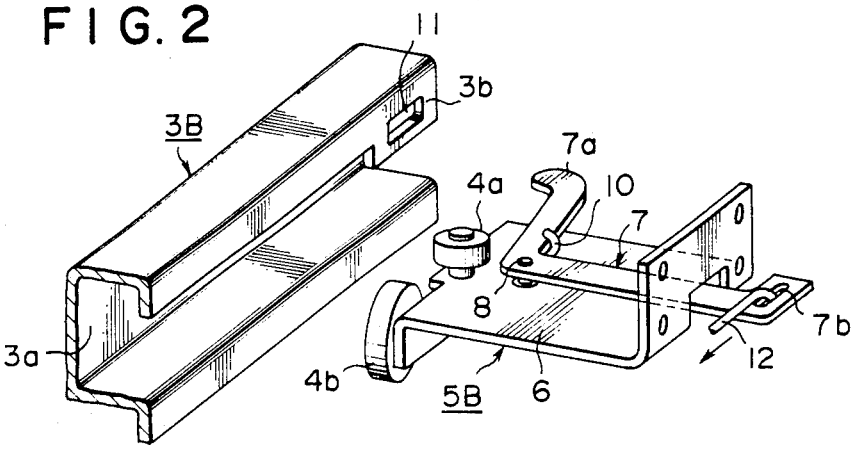
FIG. 2 is a perspective view of a conventional device for catching a fully opened sliding door.

FIG. 2 shows a typical structure of a conventional catch device for a sliding door. This catch device incorporated in a guide roller unit 5B securedly fixed to a vehicle sliding door is comprised of a bracket 6 fixedly secured to a door panel which is not shown in FIG. 2, a catch lever 7 pivoted to the bracket 6 by way of a pivot pin 8, and a catch hole 11 provided in an extension **3*b* of the guide rail 3B adapted to be engaged with a hooked portion 7*a* provided at the free end of the catch lever 7. The catch lever 7 is biased by a spring 10 in such a manner that the hooked portion 7*a* becomes engaged with the catch hole 11**.

The weight of the door 2 is supported by a pair of rollers **4*b* pivoted to the bracket 6 and adapted to travel inside the guide rail 3B having a substantially U-shaped cross-section. Another roller 4*a* having a vertical pivot axis is also provided on the bracket 6 for guiding the door along the line of the sliding motion of the door 2**.

A pull rod 12 is engaged in a slot **7*b* in the other end of the catch lever 7 and the other end of the pull rod 12 is connected to a door handle 2*a* (FIG. 1) to force the catch lever 7 against the biasing force of the spring 10 when disengaging the catch lever 7 from the catch hole 11**.

Figure 3:
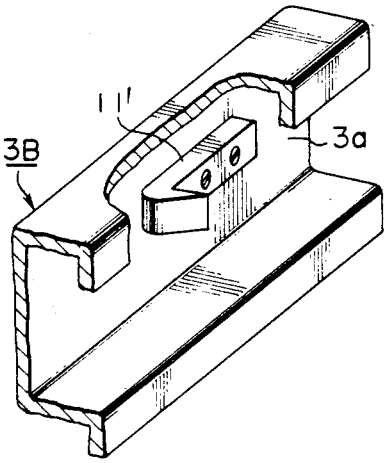
FIG. 3 is a view similar to FIG. 2 showing another device for catching a fully opened sliding door.

And this catch hole 11 may be alternatively replaced by a catch member 11' with a hooked shape fixedly secured to a vertical wall **3*a* of the guide rail 3B as shown in FIG. 3**.

In either case, it is not desirable from the view point of appearance to have a hole or an engagement member protruding from the waist guide rail which is clearly visible from outside. Moreover, such a protrusion or a hole is not desirable from the view point of safety.

DISCLOSURE OF THE INVENTION

In view of such shortcomings of conventional devices for catching a fully opened sliding door of a vehicle, a primary object of this invention is to provide such a device which is free from the above-mentioned shortcomings.

According to this invention, such an object is accomplished by providing a device for catching a fully opened sliding door of a vehicle, comprising a guide rail fixed to a vehicle body, a bracket pivoted to the door about a vertical axial line, a catch lever pivoted to the bracket, a catch means provided on the guide rail for coaction with the catch lever and a stopper means provided on the bracket for limiting the range of the possible motion of the catch lever, the door panel being slidable along the side of the vehicle body as the bracket moves along the guide rail, the catch means being positioned so that the catch means becomes engaged with the catch lever when the bracket has reached a position corresponding to the fully opened position of the door panel.

BEST MODE OF CARRYING OUT THE INVENTION

Now this invention is described in the following with respect to its specific embodiments with reference to FIGS. 4 to 9.

Figure 4:
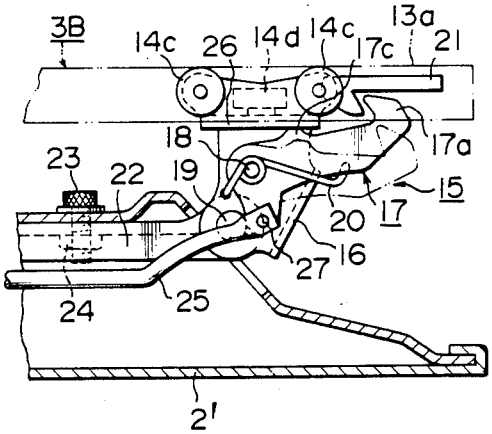
FIG. 4 is a sectional plan view taken along line IV—IV of FIG. 1 showing an embodiment of the invention.

FIG. 4 shows a catch device 15 according to this invention when the sliding door is fully opened. A mounting rod 22 is fixedly secured inside a door panel 2' by way of a bolt 23 and a nut 24 and bracket 16 is pivoted at the external end (the rear end) of this mounting rod 22 by way of a vertical pivot shaft 19. A catch lever 17 is pivoted on this bracket 16 by way of a vertical pin 18.

The bracket 16 is also provided with a support roller **14*d* pivoted about a horizontal axial line for supporting the weight of the sliding door and guide rollers 14*c*** pivoted about vertical axial lines guiding the sliding door along the line of its sliding motion.

The catch lever 17 is provided with a hooked portion **17*a* at its free end and is biased by a spring 20 so as to force the hooked portion 17*a* toward the guide rail 3B** and into engagement with a catch member 21 fixedly secured to the bottom wall (vertical wall) of the rear portion 13*a* of the guide rail 3B having a substantially U-shaped cross section and presenting its open side sideways. A rear end of a pull rod 25 is pivoted to the other end of the catch lever 17 opposite to the hooked portion 17*a*, by way of a pivot pin 27, and the front end of the pull rod 25 is connected to the door handle 2*a* so that the catch lever 17 may be disengaged from the engagement member 21 fixed to the guide rail 3B against the biasing force of the spring 20 by pulling the door handle 2*a*.

And, to prevent the hooked portion 17*a* from becoming engaged with the guide rail 3B, the catch lever 17 is provided with a protrusion 17*c* between the hooked portion 17*a* and the pivot pin 18 and a stopper plate 26 is fixedly secured to the bracket 16 where it can prevent the catch lever 17 from turning excessively counterclockwise in FIG. 4 by coming into contact with the protrusion 17*c* of the catch lever 17.

When the hooked portion 17*a* of the catch lever 17 is fully engaged with the engagement member 21, a great force is required to cause their disengagement, causing a great tension in the pull rod 25 and its connections. To avoid this inconvenience, a certain gap is provided between the hooked portion 17*a* of the catch lever 17 and the engagement member 21, as shown in FIG. 4 when the door is fully opened.

Figure 9:
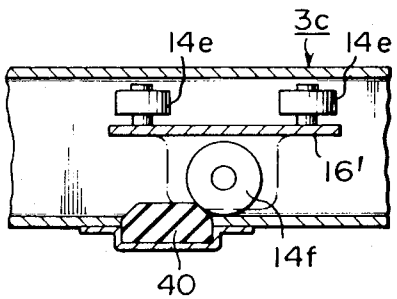
FIG. 9 is a longitudinal sectional view taken along line IX—IX of FIG. 8.
Figure 8:
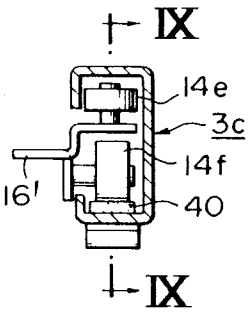
FIG. 8 is a cross-sectional view taken along line VIII—VIII of FIG. 1, showing a means for biasing the sliding door towards its fully opened position.

For the purpose of keeping the gap between these two members when the door is fully opened, a protrusion 40 is provided on the floor guide rail 3C as shown in FIGS. 8 and 9 so that a support roller 14*f* pivotally mounted on a bracket 16' rides over this protrusion 40 and the vehicle door is biased by a downward slope of this protrusion 40 toward the fully opened position. The protrusion 40 is preferably made of elastic material and the bracket 16' is fixedly secured to the door panel substantially in the same way as the bracket 16.

This feature is highly effective for keeping the force required to operate the door handle to close the sliding door when it is fully opened sufficiently small, even when the vehicle is parked on an uneven floor.

Figure 5:
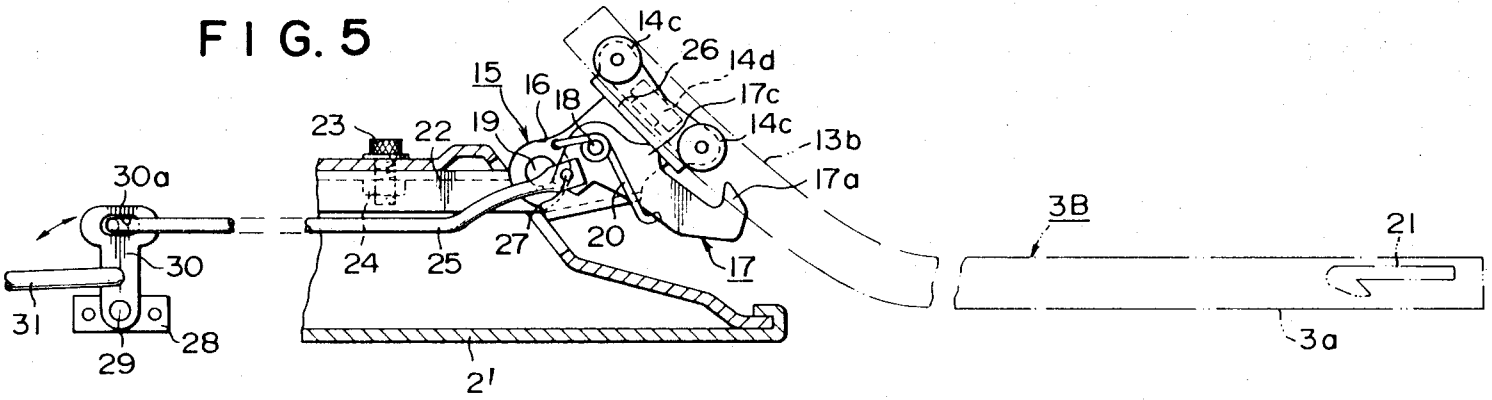
FIG. 5 is a view similar to FIG. 4 showing the same embodiment as it passes along a curved portion of a guide rail.

FIG. 5 shows the same device when the sliding door is fully closed. The rollers 14*c* and 14*d* are located in the inwardly curved portion 13*b* of the guide rail 3B and the bracket 16 can adapt itself to the curvature of the guide rail 3B by pivoting, in this case, clockwise about the pivot axis 19. Even when the bracket 16 has thus pivoted, the catch lever 17 can maintain the same state relative to the guide rail 3B because the protrusion 17*c* of the catch lever 17 is stopped by the stopper plate 26. Thus, the hooked portion 17*a* remains only slightly protruding inside the guide rail 3B.

The pull rod 25 connected to the catch lever 17 is, at its front end, engaged to a slot 30*a* of a lever 30 which is in turn pivoted to a bracket 28, fixed to the door panel 2', by way of a pin 29. And another pull rod 31 is also connected to the lever 30 and the other end of this pull rod 31 is connected to the door handle 2*a*.

It is also possible to use a pull rod 25 whose front end is provided with a slot and to provide a pin in the catch lever 17 instead of the slot 30*a*.

The reason for providing play with the slot 30*a* in the pull rod connection is to prevent the transmission of force to the second pull rod 31 from the first pull rod 25 when the catch lever 17 is rotated along with the bracket 16 due to the change in the relative position of the door panel 2' and the guide rail 3B as the bracket 16 passes along the curved portion 13*b* of the guide rail 3B.

Figure 6:
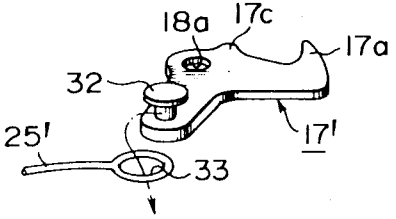
FIGS. 6 and 7 are perspective views showing different embodiments of the catch lever.
Figure 7:
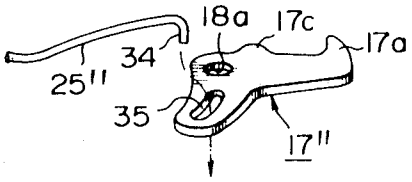

The play in the pull rod connection can be also obtained by providing play in the connection between the pull rod 25 and the catch lever 17. FIG. 6 shows such a connection in which a loop 33 formed at the rear end of the pull rod 25' is engaged to a pin 32 fixedly secured to the catch lever 17'. FIG. 7 shows another example of such a connection in which a slot 35 is provided in the catch lever 17'' and the rear end of the pull rod 25'', which is simply bent downwardly, is fit into the slot 35. In FIGS. 6 and 7, numeral 18*a* denotes a hole in the catch lever 17 for accomodating the pivot pin 18.

Now the manner of operation of the device for catching a sliding door of a vehicle according to this invention is described in the following.

When the sliding door 2 is slid open, the bracket moves along the guide rail 3B guided by the rollers 14*c* and 14*d* travelling in the guide rail 3B. And as the rollers pass along the curved portion 13*b* of the guide rail 3B, the bracket 16 is pivoted about its pivot axis and the catch lever 17 is prevented from protruding too deeply into the guide rail 3B as the protrusion 17*c* limits the pivoting motion of the catch lever 17. Thus the hooked portion 17*a* is not interfered by the curved portion 13*b* of the guide rail 3B, whereby smooth opening and closing of the sliding door is assured.

When the sliding door 2 is about to be fully opened, the hooked portion 17*a* of the catch lever 17 rides over the hooked portion of the catch member 21 fixed to the guide rail and ultimately gets engaged with the catch member 21. This engagement is strong enough to hold the door open even when the vehicle is parked on a slope. And this engagement is released by pulling the handle 2*a* which in turn pulls the pull rod 25 and rotates the catch lever 17 clockwise in FIG. 4 against the biasing force of the spring 20.

Since the bracket 16 can pivot according to the motion of the rollers in the guide rail 3B, this catch device can be conveniently provided also in the waist portion of the slide door without presenting any protrusion from the inner panel 2' toward the interior of the vehicle.

Furthermore, since the catch lever is prevented from excessive rotation by its protrusion 17*c* which may contact the stopper plate 26 of the bracket 16, the hooked portion 17*a* is not interfered by the guide rail 3B as it passes the curved portion 13*b* of the guide rail 3B.

Additionally, since the hooked portion 17*a* can engage to the catch member 21 provided well inside the guide rail 3B with a U-shaped cross-section, the catch member 21 does not protrude from the guide rail which is exposed to the outside. And even when this engagement member 21 is provided in the waist guide rail, it does not impair the external appearance of the vehicle nor cause any danger of catching a part of a passenger or the like.

Furthermore, in the catch device according to this invention, it is possible to provide play which interrupts the transmission of the force arising from the change in the relative position between the door panel 2 and the guide rail 3B as the catch lever 17 passes along the curved portion 13*b* of the guide rail 3B. This is important because the provision of the protrusion 17*c* in the catch lever 17 can otherwise transmit force to the pull rod 25.

Although the present invention was described in terms of its specific embodiments, it is obvious to a person skilled in the art that various modifications and alterations in the actual utilization of the invention are possible without departing from the spirit of this invention which is described in the appended claims.

What is claimed is:

1. A device for catching a fully opened sliding door of a vehicle, comprising:

a guide rail fixed to a vehicle body;

a bracket pivoted to a door panel and moveable along the guide rail;

a catch lever provided with a hooked portion at its free end and biased by a spring, said spring forcing said hooked portion toward the guide rail, said catch lever being pivoted to the bracket at the other end by a pivot pin;

catch means provided on the guide rail for engaging said catch lever;

stopper means provided on the bracket for limiting the range of possible swinging motion of the catch lever;

said door panel being slidable along the side of the vehicle body as the bracket moves along the guide rail, the catch means being positioned so that the catch means becomes engaged with said hooked portion of the catch lever when the bracket has reached the position corresponding to the fully opened position of the door panel;

said catch lever having a protrusion located between the hooked portion and the pivot pin, and said protrusion contacting said stopper means.

2. A device according to claim 1, wherein the bracket is provided with at least one roller which rolls along the surface of the guide rail.

3. A device according to claim 2, wherein the catch lever is connected to a linkage means which is adapted to disengage the catch lever from the catch means provided on the guide rail.

4. A device according to claim 3, wherein the guide rail has a substantially U-shaped cross-section.

5. A device according to claim 4, wherein the catch means is fixedly secured to a bottom wall of the guide rail without protruding from the profile of the guide rail.

6. A device according to claim 4, wherein the catch means is a substantially rectangular hole provided in an extension of the guide rail.

7. A device according to claim 1, wherein the catch lever is connected to a linkage means which is adapted to disengage the catch lever from the catch means provided on the guide rail.

8. A device according to claim 1, wherein the catch means is a substantially rectangular hole provided in an extension of the guide

9. A device according to claim 1, wherein the guide rail has a substantially U-shaped cross-section.

10. A device according to claim 9, wherein the catch means is fixedly secured to a bottom wall of the guide rail without protruding from the profile of the guide rail.

11. A device according to claim 10, wherein the catch means is a substantially rectangular hole provided in an extension of the guide rail.

* * * * *

UNITED STATES PATENT AND TRADEMARK OFFICE

CERTIFICATE OF CORRECTION

PATENT NO. : 4,502,246

DATED : March 5, 1985

INVENTOR(S) : Tatsuo Minami

It is certified that error appears in the above–identified patent and that said Letters Patent are hereby corrected as shown below:

Column 6, line 23, after "guide" insert --rail--.

Signed and Sealed this

*Sixteenth* Day of *September 1986*

[SEAL]

*Attest:*

DONALD J. QUIGG

*Attesting Officer*

*Commissioner of Patents and Trademarks*